United States Patent [19]

Yamamoto

[11] Patent Number: 4,492,540

[45] Date of Patent: Jan. 8, 1985

[54] VARIABLE-DISPLACEMENT VANE COMPRESSOR WITH ONE OR MORE FERROMAGNETIC VANES

[75] Inventor: Katsuichi Yamamoto, Saitama, Japan

[73] Assignee: Diesel Kiki Co., Ltd., Tokyo, Japan

[21] Appl. No.: 500,624

[22] Filed: Jun. 3, 1983

[30] Foreign Application Priority Data

Jun. 14, 1982 [JP] Japan ..... 57-101775

[51] Int. Cl.[3] ..... F04C 18/00; F04C 29/10

[52] U.S. Cl. ..... 418/23; 418/152; 418/158; 418/179

[58] Field of Search ..... 418/23, 152, 158, 179; 417/214

[56] References Cited

U.S. PATENT DOCUMENTS

| | | | |
|---|---|---|---|
| 4,050,263 | 9/1977 | Adalbert et al. | 418/158 |
| 4,132,512 | 1/1979 | Roberts | 418/158 |
| 4,331,223 | 5/1982 | Charlat et al. | 418/158 |

FOREIGN PATENT DOCUMENTS

| | | | |
|---|---|---|---|
| 50-15216 | 5/1975 | Japan | 418/158 |

*Primary Examiner*—John J. Vrablik

*Attorney, Agent, or Firm*—Frishauf, Holtz, Goodman & Woodward

[57] ABSTRACT

A variable-displacement vane compressor has a pump housing and a cylindrical rotor supported on a drive shaft and rotatably disposed in the pump housing. The rotor has a plurality of vanes movably fitted in respective slits formed in the rotor and having radially outward ends slidable against an inner peripheral camming surface of the pump housing. Certain ones of the vanes are made of a ferromagnetic material and can be retracted back into the slits in response to energization of an electromagnetic coil to thereby reduce the volume of a fluid discharged from pump working chambers in the pump housing. When the electromagnetic coil is de-energized, all of the vanes are slidably held against the inner peripheral camming surface to discharge the compressed fluid in an increased volume.

4 Claims, 2 Drawing Figures

VARIABLE-DISPLACEMENT VANE COMPRESSOR WITH ONE OR MORE FERROMAGNETIC VANES

BACKGROUND OF THE INVENTION

The present invention relates to a vane compressor for use in air conditioning systems for vehicles, and more particularly to a variable-displacement vane compressor capable of varying the volume of discharge under the control of electromagnetic forces.

Various methods have been practiced for controlling the volume of discharge from vane compressors. One such method is to restrict the volume of a gas to be compressed at a suction side of the compressor. According to another control process, discharged gas is fed back to the suction side through a bypass passage. These prior control arrangements are disadvantageous, however, in that the work performed by the compressor remains substantially the same irrespective of whether the volume of the discharged gas is increased or decreased. The result is often wasteful consumption of power.

The specification of Japanese Utility Model Publication No. 50-15216, entitled "Rotary Compressor", discloses vanes of a ferromagnetic material which are retractable under electromagnetic forces back into an inoperative position. The disclosed compressor is merely designed to assume either a position in which a compressed fluid is discharged in a full volume or a position in which no compressed fluid is discharged. Thus the compressor fails to limit the volume of discharge to a desired degree under variable-displacement control.

SUMMARY OF THE INVENTION

It is an object of the present invention to provide a variable-displacement vane compressor capable of discharging a compressed fluid selectively in two different volumes.

Another object of the present invention is to provide a variable-displacement vane compressor which consumes a reduced amount of power when operating in a mode for discharging a compressed fluid of a reduced volume.

Still another object of the present invention is to provide a variable-displacement vane compressor having a relatively simple electrically-actuated means for controlling the volume of discharge of a compressed fluid.

According to the present invention, some of a plurality of vanes movably fitted in slits in a rotor and slidable against a camming surface of a pump housing are made of a ferromagnetic material, while the remaining vanes are made of a non-magnetic material. The ferromagnetic vanes can be retracted back into the slits out of sliding contact with the camming surface when an electromagnetic coil disposed in the pump housing is energized, thereby reducing the volume of a compressed fluid being discharged from pump working chambers defined in the pump housing. When the electromagnetic coil is de-energized, all vanes are held in sliding contact with the camming surface while the rotor is rotating. The fluid as compressed is then allowed to be discharged in an increased amount.

The above and other objects, features and advantages of the present invention will become more apparent from the following description when taken in conjunction with the accompanying drawings in which a preferred embodiment of the present invention is shown by way of illustrative example.

DETAILED DESCRIPTION

Figure 1:
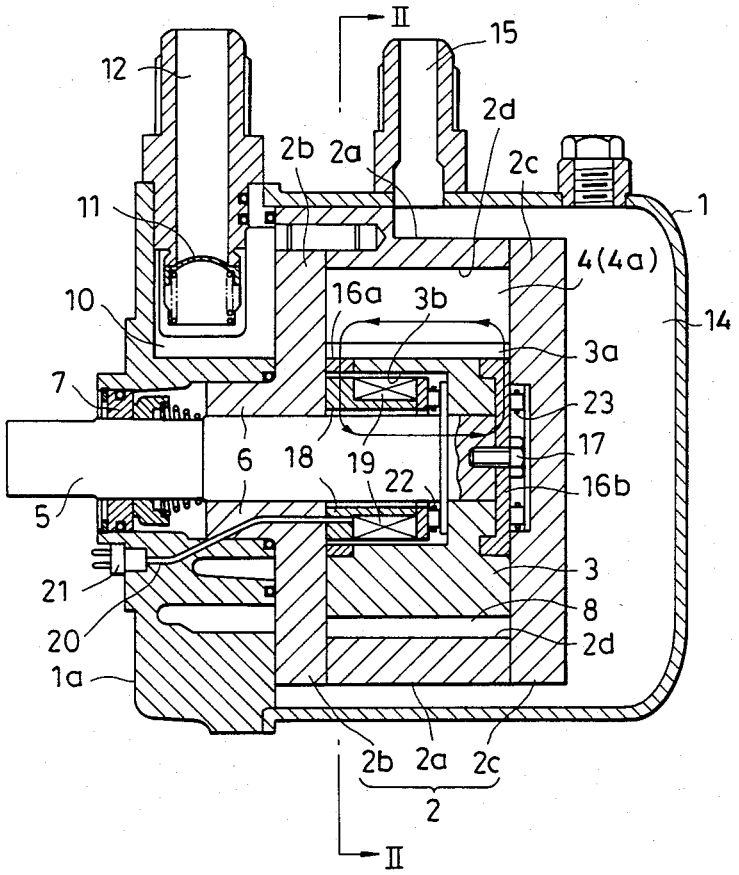
FIG. 1 is an axial vertical cross-sectional view of a variable-displacement vane compressor.
Figure 2:
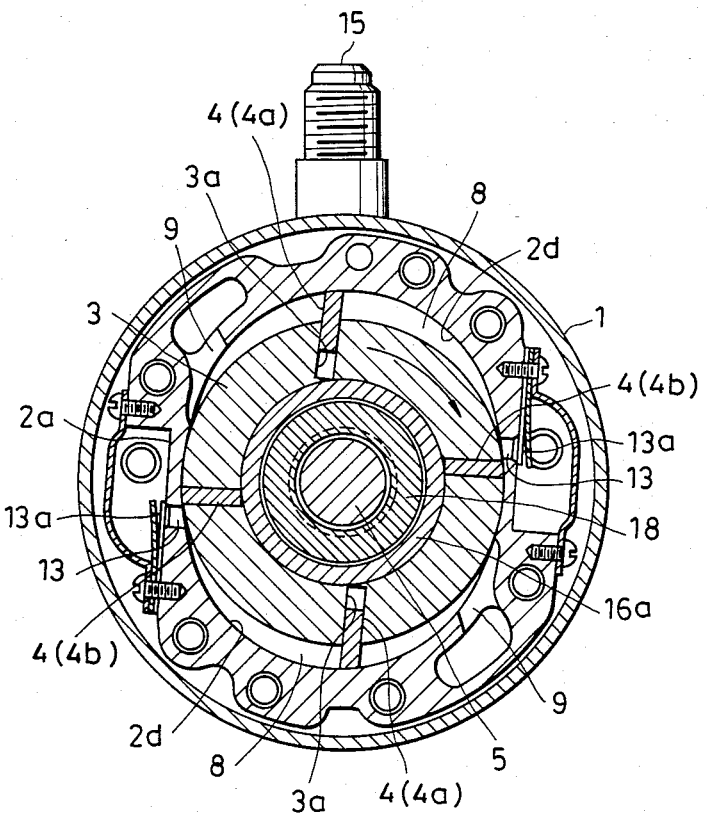
FIG. 2 is a cross-sectional view taken along line II—II of FIG. 1.

As shown in FIGS. 1 and 2, a variable-displacement vane compressor according to an embodiment of the invention comprises a cylindrical casing 1 accommodating therein a pump housing 2 composed of a cam ring 2*a*, and front and rear side blocks 2*b*, 2*c* joined respectively to axial ends of the cam ring 2*a*. The cam ring 2*a* has an inner peripheral camming surface 2*d*. A cylindrical rotor 3 is rotatably mounted in the pump housing 2 in axially confined relation between the front and rear side blocks 2*b*, 2*c*. The cylindrical rotor 3 has a plurality (four in the illustrated embodiment) of circumferentially spaced, or substantially angularly equidistant, axial slits 3*a* in which a plurality (four in the illustrated embodiment) of vanes 4 are radially movably fitted, the slits 3*a* and the vanes 4 extending axially of the cylindrical rotor 3. The vanes 4 have radially outward ends directed for slidable engagement with the inner peripheral camming surface 2*d*. The cylindrical rotor 3 is fitted over an end portion of a drive shaft 5 rotatably journalled in a bearing 6 formed integrally with the front side block 2*b*. The drive shaft 5 has an opposite end portion which is sealed by a fluid-tight sealing means 7 and extends axially through a front head 1*a* attached to the casing 1 and supporting the front side block 2*b*.

The cylindrical rotor 3 and the pump housing 2 jointly define therebetween a pair of diametrically opposite pump working chambers 8, 8 of crescent shape, as shown in FIG. 2. Each pump working chamber 8 is composed of a plurality of variable-volume chambers defined by adjacent vanes 4, the rotor 3, and the housing 2. A variable-volume chamber in each pump working chamber 8 on the suction stroke communicates through a pump inlet 9 with a suction chamber 10 defined in the front head 1*a*. The suction chamber 10 is held in communication with a suction port 12 through a check valve 11. A variable-volume chamber on the discharge stroke can communicate through a pump outlet 13 having a discharge valve 13*a* with a discharge pressure chamber 14 defined between a rear end of the pump housing 2 and the casing 1. A discharge port 15 is mounted on the casing 1 in communication with the discharge pressure chamber 14. The vane compressor of the foregoing construction is basically the same as that of the prior art.

According to the present invention, selected ones of the vanes 4, a diametrically opposite pair 4*a*, for example, are made of a ferromagnetic material, and the remaining vanes 4*b* are made of a non-magnetic material. The pump housing 2 and the rotor 3 are also made of a nonmagnetic material. Examples of such non-magnetic material include aluminum, ceramic, and synthetic resin. The rotor 3 includes therein a cylindrical recess 3*b* extending coaxially with the drive shaft 5 and opening toward the front side block 2*b*. A magnetically conductive ring 16*a* of a ferromagnetic material extends around the drive shaft 5 and is joined to an end surface of the rotor 3 which faces the front side block 2b. A magnetically conductive plate 16b of a ferromagnetic material is joined to an opposite end surface of the rotor 3 which faces the rear side block 2c. The magnetically conductive plate 16b is fastened by a bolt 17 to the drive shaft 5 which is also made of a ferromagnetic material. A cylindrical yoke 18 is attached to the front side block 2b and positioned in the recess 3b in the rotor 3. The cylindrical yoke 18 supports an electromagnetic coil or solenoid 19 wound thereon with gaps defined between the coil 19 and the drive shaft 5 and between the coil 19 and the rotor 3. The electromagnetic coil 19 has lead wires 20 extending through the yoke 18, the front side block 2b and the front head 1a and connected to an inlet plug 21 mounted on the front head 1a. A thrust bearing 22 is mounted on the bottom of the recess 3b in the rotor 3 and held axially against the yoke 18. Another thrust bearing 23 is mounted on the bottom of a recess in the rear side block 2c and held axially against the magnetically conductive plate 16b. These thrust bearings 22, 23 serve to bear an axial load or thrust imposed by the drive shaft 5.

The variable-displacement vane compressor constructed as described hereinabove operates in the following manner. With the electromagnetic coil 19 in the de-energized state, no magnetic forces are produced by the coil 19, allowing the ferromagnetic vanes 4a and also the non-magnetic vanes 4b to be freely slidable in the slits 3a. At this time, the compressor is operable to discharge a compressed fluid in a full volume. More specifically, when the drive shaft 5 is driven to rotate the rotor 3, the vanes 4a, 4b are pushed radially outwardly under centrifugal force owing to rotation of the rotor 3 and back pressure of a lubricant oil acting on the bottoms of the slits 3a. The vanes 4a, 4b are therefore held in sliding contact with the camming surface 2d while the rotor 3 is rotating. Whenever each of the vanes 4a, 4b moves across one of the pump inlets 9, a fluid, typically refrigerant, is drawn from the suction port 12 through the check valve 11, the suction chamber 10 and the pump inlet 9 into the variable-volume chamber on the suction stroke, which progressively increases in volume as the rotor 3 rotates in the direction of the arrow (FIG. 2). After the variable-volume chamber has reached its maximum volume, it starts to compress the fluid it contains as the chamber gradually diminishes in volume on the compression or discharge stroke. The compressed fluid is then discharged from the chamber on the compression stroke through the pump outlet 13, pushing the discharge valve 13a to open, and is expelled into the discharge pressure chamber 14. The compressed fluid is accumulated in the discharge pressure chamber 14 and then discharged through the discharge port 15 into a refrigerating circuit (not shown) to which the compressor is connected. The foregoing cycle of compressive operation is repeated again and again to discharge the compressed fluid in a continuous manner. With the illustrated compressor having two diametric chambers and four vanes, eight successive compressive operations are effected for every single revolution of the rotor 3.

When the electromagnetic coil 19 is energized by passing an electric current through the lead wires 20, the coil 19 creates a magnetic field with lines of magnetic force running along a closed loop, as shown by the arrow in FIG. 1, composed of the drive shaft 5, the magnetically conductive plate 16b the vanes 4a, and the magnetically conductive ring 16a. At this time, only the ferromagnetic vanes 4a in the slits 3a are attracted radially inwardly toward the center of the rotor 3. The electromagnetic coil 19 is designed and the current passing therethrough is selected so that the attractive force produced by the coil 19 will be greater than the sum of the centrifugal forces and the lubricant back pressure, both of which act on the vanes 4a during rotation of the rotor 3. Where a diametrically opposite pair of the four vanes 4 is made of a ferromagnetic material, as in the illustrated embodiment, the compressor can perform four compressive actions each time the rotor 3 makes one revolution. The volume of a fluid discharged in this limited discharge mode is preferably about 70% of that in the ordinary full-volume discharge mode.

The vane compressor according to the present invention may have a single pump working chamber or more than two pump working chambers, and also may have two or more vanes, which are either an even number of vanes or an odd number of vanes. The number and position of those vanes which are made of a ferromagnetic material can be selected as desired. Advantageously, the foregoing discharge volume control is carried out by detecting the rotational speed (rpm) of the drive shaft 5, and generating a signal when the detected rpm exceeds a predetermined rpm to energize the electromagnetic coil 19.

Any desired ratio between full and reduced volumes of discharge can be established by appropriately selecting the number and position of ferromagnetic vanes used. While the vane compressor is being operated in a reduced-volume discharge mode, the compressor consumes a reduced amount of power. The operation of the compressor can be controlled by an electric signal only without having to rely on fluid control of valves which cannot be actuated as quickly and smoothly as the magnetically operated vanes. With the electromagnetic coil supported on the yoke mounted in the pump housing, there is no need for connecting means such as a slip ring which is complex in structure and poor in operative reliability. The variable-displacement vane compressor of the present invention is particularly suitable for use as a compressor in an air conditioning system in a vehicle in which the compressor is coupled to the engine more or less directly, i.e., at a speed reduction ratio of about 1:1. In such an application, the compressor is controlled to operate in the reduced-volume discharge mode when the engine rotates at high speed or when the cooling load is relatively small. This eliminates the problem of wasteful power consumption or the freezing-over of the evaporator in the air conditioning system, which would otherwise be caused by the compressor operating with an excessive cooling capability.

Although a certain preferred embodiment has been shown and described, it should be understood that many changes and modifications may be made therein without departing from the scope of the appended claims.

What is claimed is:

1. A variable-displacement vane compressor comprising:

a pump housing having an inner peripheral camming surface, said pump housing having a cam ring defining said inner peripheral camming surface, and a pair of side blocks joined to axial ends of said cam ring, said cam ring and said side blocks being made of a non-magnetic material;

a drive shaft rotatably journalled in said pump housing, said drive shaft being made of a ferromagnetic material;

a cylindrical rotor mounted on said drive shaft and disposed in said pump housing, said cylindrical rotor being made of a non-magnetic material, said pump housing and said cylindrical rotor defining at least one pump working chamber therebetween, said cylindrical rotor having a plurality of axial slits spaced circumferentially and a plurality of vanes movably fitted in respective ones of said axial slits and having radially outward ends slidable against said inner peripheral camming surface in response to rotation of said cylindrical rotor for compressing a fluid in a variable-volume chamber in said pump working chamber which is defined by adjacent ones of said vanes, said inner peripheral camming surface and said cylindrical rotor, said plurality of vanes being divided into a first group made of a ferromagnetic material and a second group made of a non-magnetic material, and said cylindrical rotor having a recess coaxial with said drive shaft; and an electromagnetic coil accommodated in said recess of said cylindrical rotor in a stationary manner and disposed around said drive shaft, said electromagnetic coil being controllably energizable and de-energizable for maintaining said first group of said vanes in and out of sliding contact with said inner peripheral camming surface, whereby the volume of the compressed fluid can be discharged in a variable volume from said pump working chamber.

2. A variable-displacement vane compressor according to claim 1, wherein said non-magnetic material is selected from the group consisting of aluminum, ceramics and synthetic resin.

3. A variable-displacement vane compressor according to claim 1, wherein said at least one pump working chamber comprises a pair of diametrically opposite pump working chambers, said plurality of vanes comprising four substantially angularly equidistant vanes, said first group of vanes being comprised of a diametrically opposite pair of said four vanes.

4. A variable-displacement vane compressor according to claim 1, wherein said cylindrical rotor includes a magnetically conductive ring extending around said drive shaft and axially facing one of said side blocks, and a magnetically conductive plate axially facing the other one of said side blocks.

* * * * *